US007438575B2

(12) United States Patent
Chen et al.

(10) Patent No.: US 7,438,575 B2
(45) Date of Patent: Oct. 21, 2008

(54) ELECTRICAL CONNECTOR

(75) Inventors: Xiao-Zhu Chen, Shenzhen (CN); Ke Sun, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/829,096

(22) Filed: Jul. 27, 2007

(65) Prior Publication Data

US 2008/0207031 A1 Aug. 28, 2008

(30) Foreign Application Priority Data

Feb. 28, 2007 (CN) ..... 2007 1 0200241

(51) Int. Cl.
*H01R 13/44* (2006.01)

(52) U.S. Cl. ..... 439/172; 439/131

(58) Field of Classification Search ..... 439/131, 439/170, 171, 172, 174, 176, 216
See application file for complete search history.

(56) References Cited

U.S. PATENT DOCUMENTS 5,575,690 A * 11/1996 Eaton ..... 439/717
6,139,341 A * 10/2000 Hun ..... 439/172
7,108,527 B2 * 9/2006 Oldfield et al. ..... 439/176
7,121,850 B2 * 10/2006 Yeh ..... 439/131

* cited by examiner

*Primary Examiner*—James Harvey
(74) *Attorney, Agent, or Firm*—Frank R. Niranjan

(57) ABSTRACT

An electrical connector includes an enclosure, a male member, a female member, and an operating member. The enclosure defines an opening in an end thereof. The female member is slidably mounted in the enclosure, and includes a housing defining a plurality of through holes. The male member is fixed in the enclosure, and includes a plurality of pins passing through the through holes of the housing respectively. The operating member is connectable to the female member to be controlled to make the housing of the female member move out of the opening of the enclosure to allow the electrical connector to act as a female type connector; or to make the housing to be retracted in the enclosure, such that the pins extend out of the through holes of the housing to allow the electrical connector to act as a male type connector.

20 Claims, 4 Drawing Sheets

ELECTRICAL CONNECTOR

BACKGROUND

1. Field of the Invention

The present invention relates to an electrical connector.

2. Description of Related Art

With the development of electronic technology, electrical connectors for connecting various electronic equipment are widely used. Typically, a connector is defined as a male type connector or a female type connector when it is produced, and it cannot be changed between male and female type. However, two electronic devices having two identical type connectors respectively cannot be connected directly.

What is needed, therefore, is an electrical connector which is able to be changed between male and female type.

SUMMARY

An exemplary electrical connector includes an enclosure, a male member, a female member, and an operating member. The enclosure defines an opening in an end thereof. The female member is slidably mounted in the enclosure, and includes a housing defining a plurality of through holes. The male member is fixed in the enclosure, and includes a plurality of pins passing through the through holes of the housing respectively. The operating member is connectable to the female member to be controlled to make the housing of the female member move out of the opening of the enclosure to allow the electrical connector to act as a female type connector; or to make the housing to be retracted in the enclosure, such that the pins extend out of the through holes of the housing to allow the electrical connector to act as a male type connector.

Other advantages and novel features will become more apparent from the following detailed description of embodiments when taken in conjunction with the accompanying drawings, in which:

DETAILED DESCRIPTION

Figure 1:
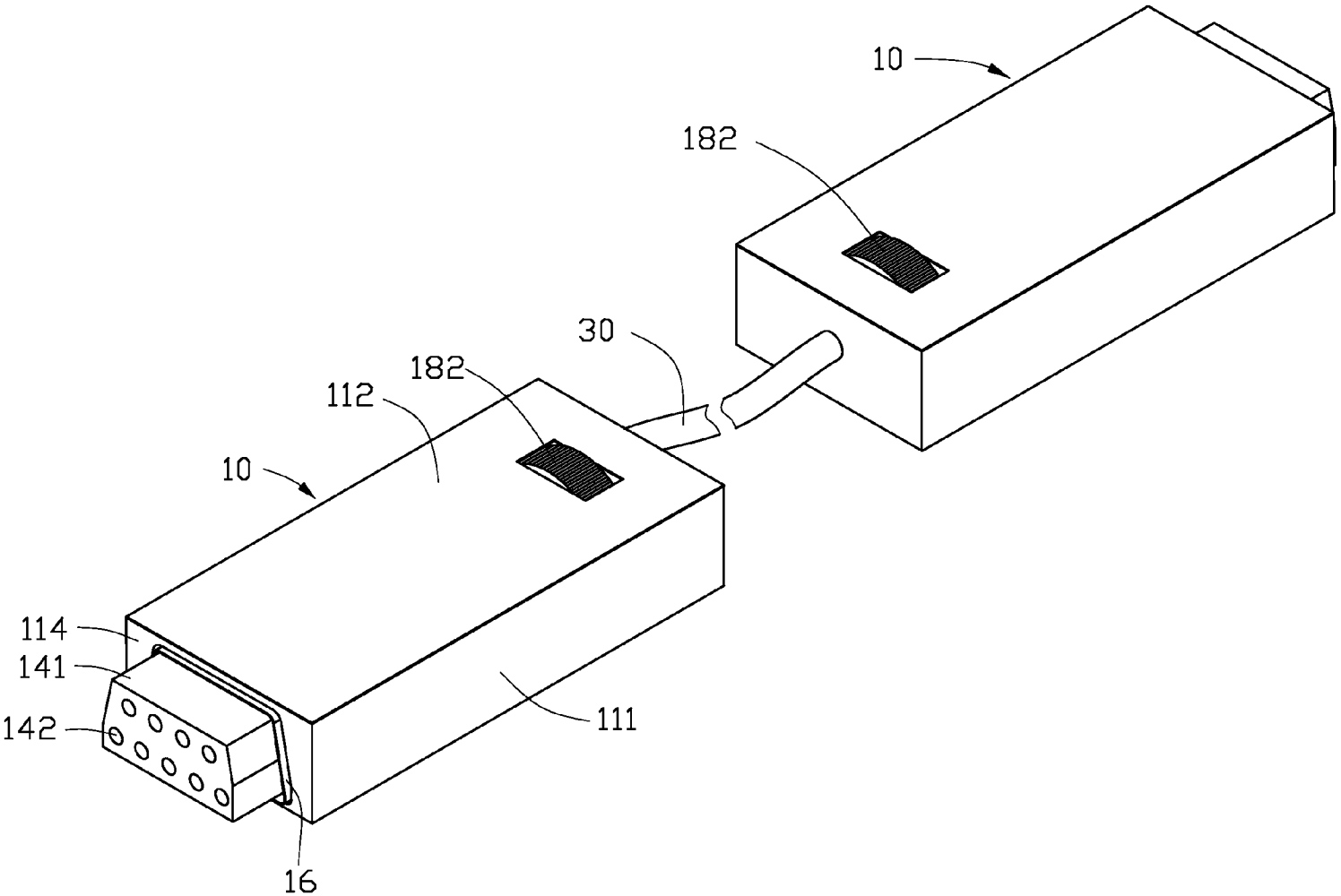
FIG. 1 is an isometric view of two electrical connectors connected with a cable in accordance with a first embodiment of the present invention.
Figure 2:
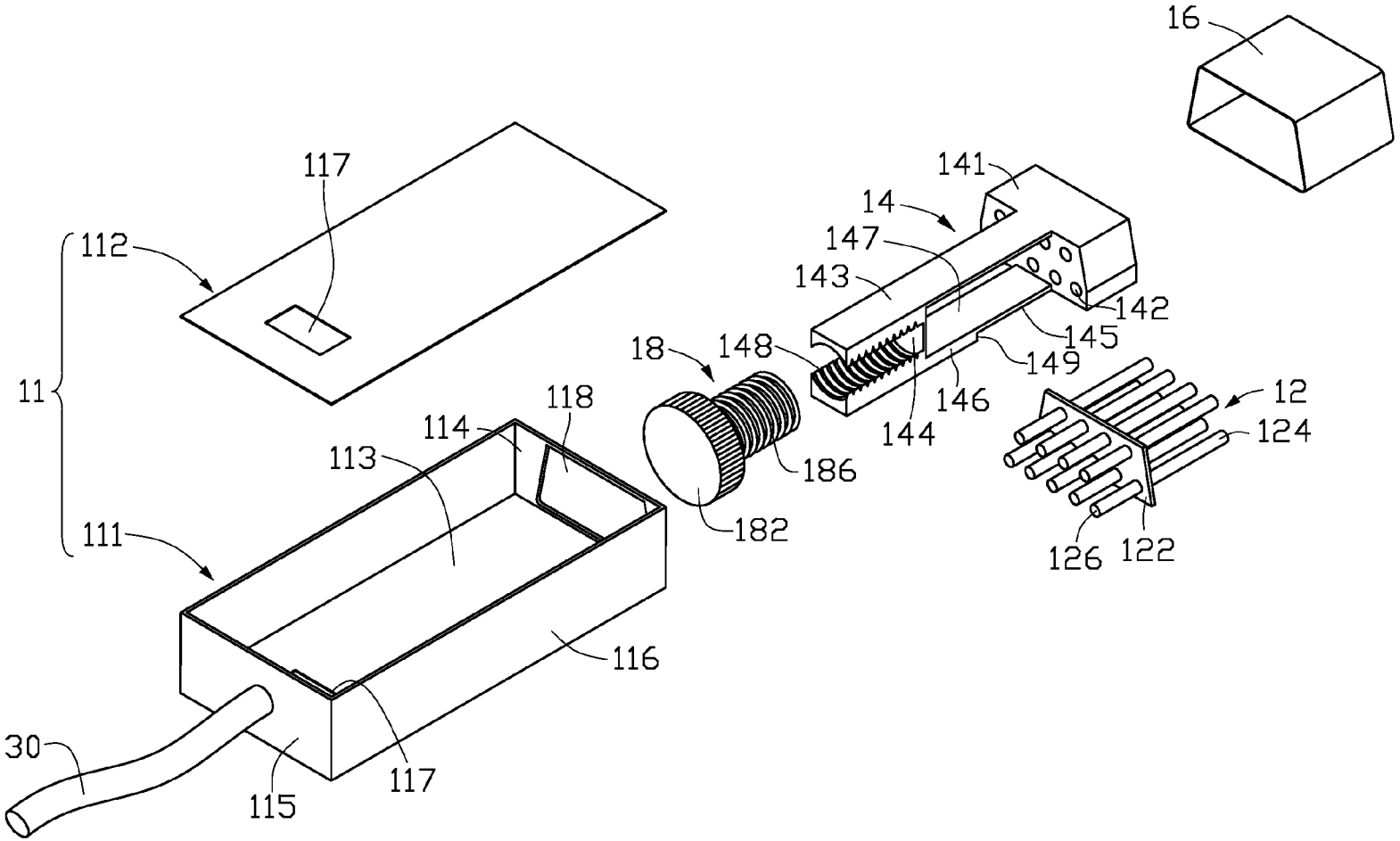
FIG. 2 is an exploded, isometric view of one connector of FIG. 1.

Referring to FIGS. 1 and 2, two electrical connectors 10 connected together with a cable 30 is provided in accordance with an embodiment of the present invention. Each of the connectors 10 includes a box-shaped enclosure 11, a male member 12, a female member 14, a fixing member 16, and an operating member 18.

The enclosure 111 includes a base 111, and a cover 112. The base 111 includes a bottom wall 113, a front wall 114, a rear wall 115, and two opposite sidewalls 116. The cable 30 is connected to the enclosure 11 by passing through the rear wall 115 of the base 111. Two aligned elongated holes 117 are respectively defined in the cover 112 and the bottom wall 113 of the base 111 adjacent to the rear wall 115. An opening 118 is defined in the front wall 114 of the base 111.

The male member 12 includes a fixing plate 122, a plurality of pins 124 is perpendicularly fixed on one side of the fixing plate 122 and extends into the fixing plate 122 to connect with a plurality of wires 126 respectively on the other side of the fixing plate 122.

The female member 14 includes a housing 141 defining a plurality of through holes 142 therein for receiving the pins 124 respectively. Length of each through hole 142 is a half of each pin 124, and an elastic foil (not shown) is installed in each through hole 142 for electrically contacting with the corresponding pin 124. A first plate 143 and a second plate 145 extend in parallel from a top section and a bottom section of a rear portion of the housing 141 respectively. A stop plate 144 is perpendicularly formed between the first plate 143 and the second plate 145, and a receiving space 147 is defined among the housing 141, the stop plate 144, the first plate 143, and the second plate 145. Two curved threaded portions 148 are formed on opposite inside surfaces of the first plate 143 and the second plate 145 respectively behind the stop plate 144. A protruding portion 146 is formed on a rear portion of an outside surface of the second plate 145, and an abutting surface 149 is formed on a junction of a front of the protruding portion 146 and the second plate 145.

The fixing member 16 is hollow, for receiving the fixing plate 122 of the male member 12 and the housing 141 of the female member 14.

The operating member 18 includes a knob 182 having a plurality of ribs, and a threaded post 186 extending perpendicularly from a center of one side of the knob 182.

Figure 3:
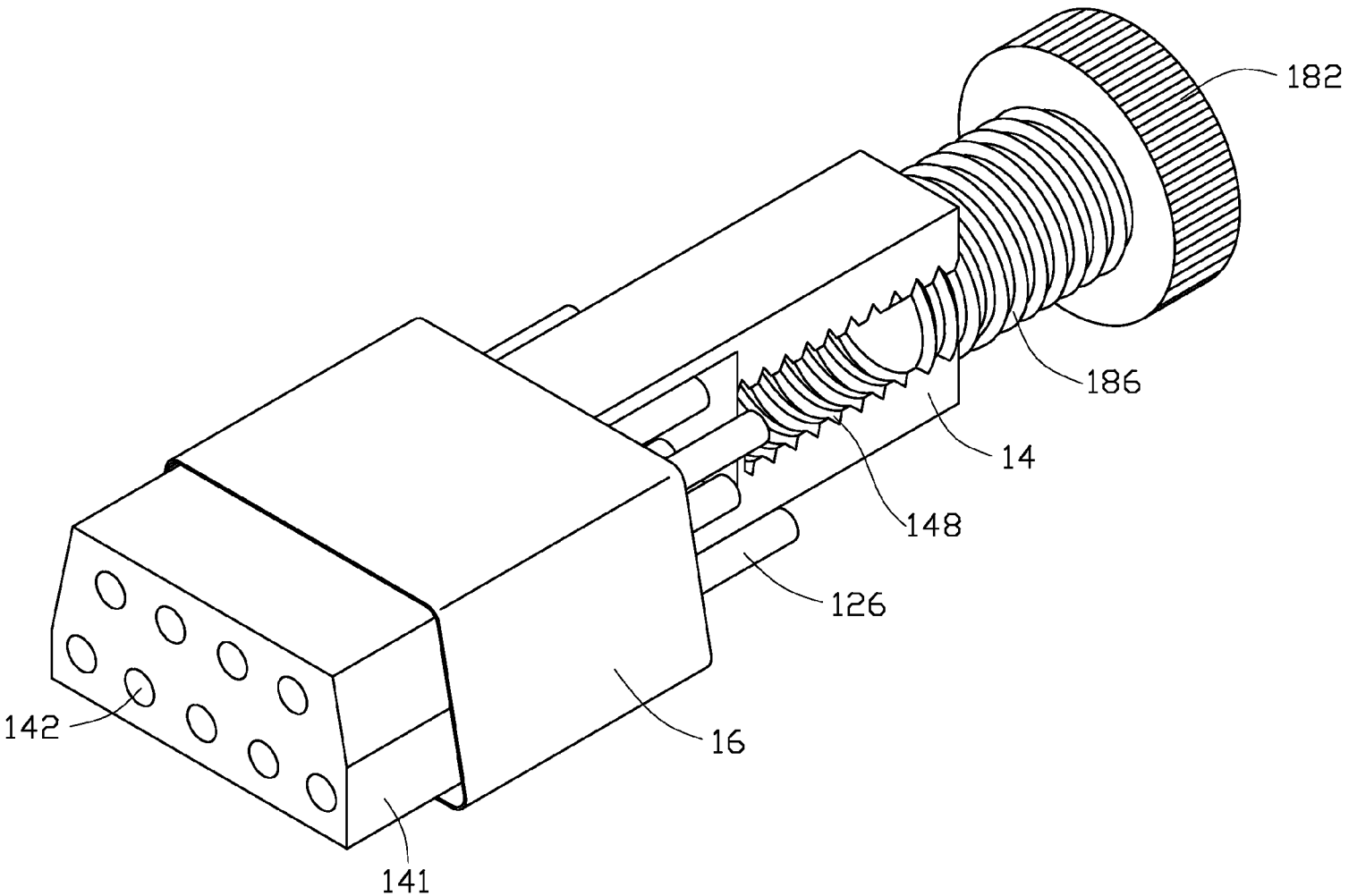
FIG. 3 is a partially assembled view of FIG. 2 without an enclosure, showing the connector configured as a female type connector.
Figure 4:
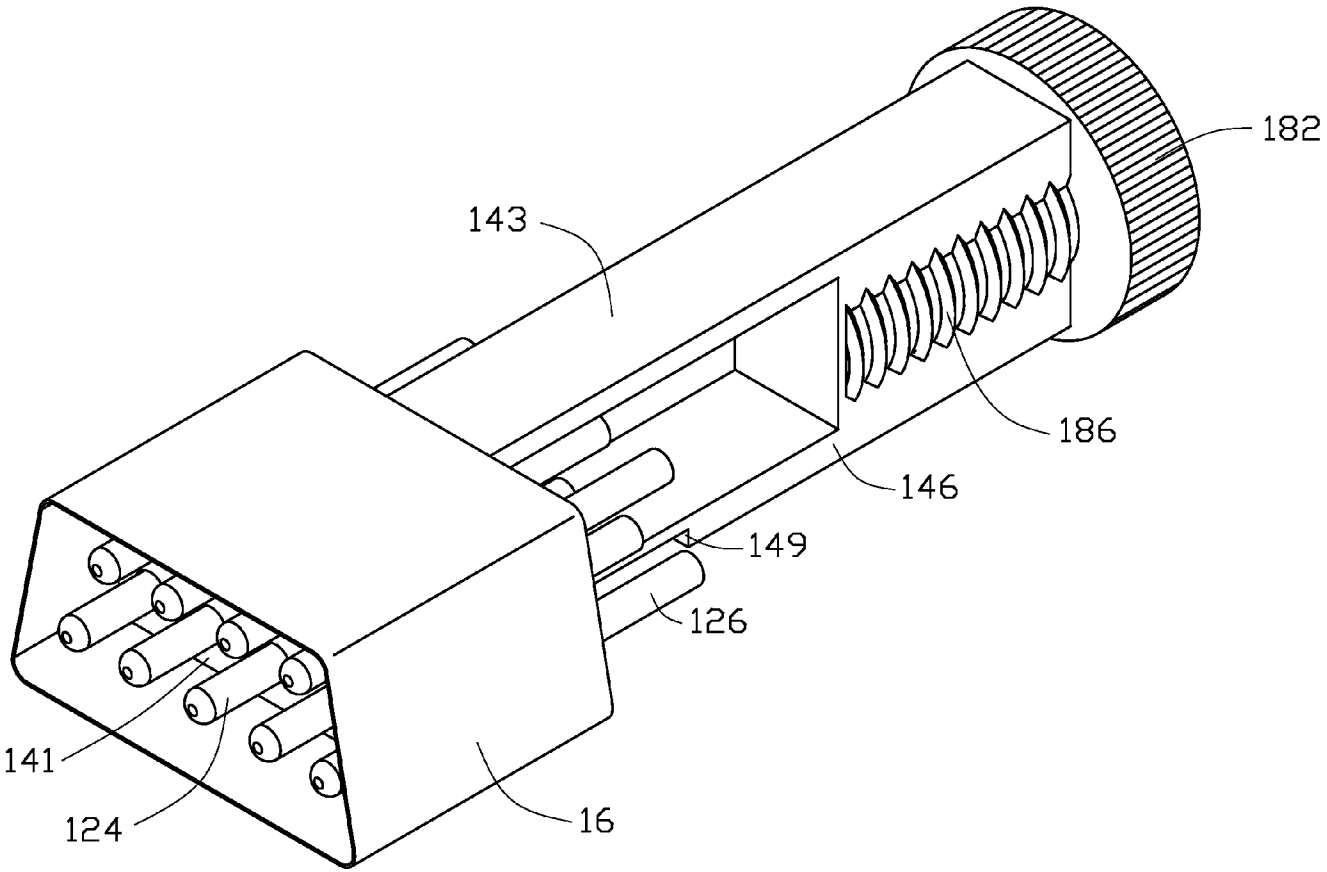
FIG. 4 is similar to FIG. 3, showing the connector configured as a male type connector.

Referring also to FIGS. 3 and 4, in assembly, the male member 12 is slidably disposed in the receiving space 147 of the female member 14, with the pins 124 of the male member 12 aligning with the through holes 142 of the housing 141 of the female member 14 respectively. The male member 12 is slid to make the pins 124 pass through the through holes 142 of the housing 141 respectively and contact with the elastic foils in the through holes 142 respectively. The housing 141 of the female member 14 and the male member 12 are together inserted into the fixing member 16. Two lateral edges of the fixing plate 122 of the male member 12 are fixed to two lateral sides on the rear portion of the fixing member 16 respectively by welding, thereby the female member 14 is slidable relative to the fixing member 16 and the male member 12. The threaded post 186 of the operating member 18 is screwed to engage with the threaded portions 148 of the first plate 143 and the second plate 145, thereby the female member 14 is movably connected with the operating member 18. Thereafter, the male member 12, the female member 14, the fixing member 16, and the operating member 18 are placed on the base 111 of the enclosure 11 together, with a front portion of the fixing member 16 engaging in the opening 118 of the front wall 114 of the base 111, and a bottom portion of the fixing member 16 adhering to the bottom wall 113 of the base 111. The knob 182 of the operating member 18 is partially exposed from the elongated hole 117 of the bottom wall 113 of the base 111. The wires 126 connected with the male member 12 are connected to the cable 30 passing through the rear wall 115 of the base 111. The cover 112 is fixed to the base 111, with the knob 182 of the operating member 18 being partially exposed from the elongated hole 117 of the cover 112. Thereby the connector 10 is assembled, and the knob 182 of the operating member 18 is rotatably engaged between the elongated holes 117 of the enclosure 11.

Referring further to FIG. 3, when the connector 10 is needed to be used as a female type connector, the exposed knob 182 is rotated in a first direction. The threaded post 186 is rotated together with the knob 182 relative to the screw threaded portions 148 of the first plate 143 and the second plate 145, to drive the female member 14 to move forward in a second direction perpendicular to the first direction until the abutting surface 149 of the second plate 145 abuts against the rear portion of the fixing member 16. The housing 141 of the female member 14 is exposed from the front portion of the fixing member 16 and the pins 124 of the male member 12 are received within the through holes 142 respectively, for electrically connecting to a male connector, as shown in FIG. 1.

Referring further to FIG. 4, when the connector 10 is needed to be used as a male type connector, the exposed knob 182 is rotated in a third direction opposite to the first direction. The threaded post 186 is rotated together with the knob 182 between the threaded portions 148 of the first plate 143 and the second plate 145, to drive the female member 14 to move backward in a fourth direction opposite to the second direction until the threaded post 186 entirely engages with the threaded portions 148, and the stop plate 144 abuts against the threaded post 186. The housing 141 of the female member 14 is drawn back to be received in the fixing member 16, and the rear portion of the housing 141 abuts against the fixing plate 122 of the male member 12. The pins 124 of the male member 12 are exposed from the through holes 142 of the housing 141 respectively, for electrically connecting to a female connector.

In other embodiments, the female member 14 can be arranged to be not connected with the operating member 18, but connected with another operating member partially, which is exposed from the enclosure 11 and is slidable together with the female member 14 forward and backward relative to the male member 12. Furthermore, the male member 12 can be connected with another operating member, which is exposed from the enclosure 11 and is slidable together with the male member 12 forward and backward relative to the female member 14, to make the pins 124 of the male member 12 extend out of or be received in the through holes 142 of the housing.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An electrical connector, comprising:

an enclosure defining an opening in an end thereof;

a female member slidably mounted in the enclosure, the female member comprising a housing, and the housing defining a plurality of through holes therein;

a male member fixed in the enclosure, the male member comprising a plurality of pins having free ends capable of passing through the through holes of the housing respectively; and an operating member connectable to the female member, the operating member being controlled to make the housing of the female member move out of the opening of the enclosure in a first position such that the free ends of the pins are received within the through holes respectively to allow the electrical connector to act as a female type connector; or to make the housing be retracted in the enclosure such that the free ends of the pins extend out of the through holes of the housing to allow the electrical connector to act as a male type connector.

2. The electrical connector as claimed in claim 1, wherein the male member comprises a fixing plate fixed to the enclosure, the pins are fixed on one side of the fixing plate.

3. The electrical connector as claimed in claim 2, wherein two plates extend perpendicularly from two opposite edges of the housing, for receiving the fixing plate of the male member movably.

4. The electrical connector as claimed in claim 3, wherein a hollow fixing member is fixed in the enclosure for receiving the male member and the housing of the female member therein, one end of the fixing member fits in the opening of the enclosure, and two opposite edges of the other end of the fixing member are fixed to the fixing plate.

5. The electrical connector as claimed in claim 4, wherein an abutting surface is formed on an outside surface of one of the plates of the female member, for abutting against the fixing member when the housing of the female member moves out of the opening of the enclosure.

6. The electrical connector as claimed in claim 3, wherein two threaded portions are formed on opposite inside surfaces of the plates adjacent to free ends thereof respectively, the operating member comprises a threaded post for movably engaging with the threaded portions of the plates such that when the threaded post is rotated, the threaded post drives the female member to move linearly.

7. The electrical connector as claimed in claim 6, wherein the enclosure defines a hole therein, the operating member further comprises a knob perpendicular to the threaded post partially exposed out of the hole of the enclosure for being operated to rotate the threaded post.

8. The electrical connector as claimed in claim 2, wherein the pins pass through the fixing plate to connect with a plurality of wires respectively, and the wires are electrically connected with a cable outside the enclosure.

9. The electrical connector as claimed in claim 1, wherein a length of each of the through holes of the housing is a half of each of the pins.

10. The electrical connector as claimed in claim 1, wherein the enclosure comprises a cover, and a base containing the male member, the female member, and the operating member.

11. An electrical connector, comprising:

an enclosure defining an opening in an end thereof;

a male member fixed in the enclosure, the male member comprising a plurality of pins, each of the pins electrically connected with a wire for electrically connecting with another electrical equipment;

a female member slidably mounted in the enclosure, the female member comprising a housing defining a plurality of through holes therein for receiving the pins respectively; and an operating member connectable to the female member to be manipulated for driving the female member to move forward or backward along the pins, the female member capable of being at least partially moved through the opening.

12. The electrical connector as claimed in claim 1, wherein the female member defines a receiving space behind the housing for movably receiving the male member therein.

13. The electrical connector as claimed in claim 12, wherein two plates extend backward and perpendicularly from two opposite edges of the housing, a stop plate is perpendicularly formed between the plates behind the receiving space.

14. The electrical connector as claimed in claim 13, wherein two threaded portions are formed on opposite inside surfaces of the plates behind the stop plate respectively, the operating member comprises a threaded post for movably engaging with the threaded portions of the plates such that when the threaded post is rotated, the threaded post drives the female member to move linearly.

15. The electrical connector as claimed in claim 14, wherein the enclosure defines a hole therein, the operating member further comprises a knob perpendicular to the threaded post partially exposed out of the hole of the enclosure for being operated to rotate the threaded post.

16. An electrical connector comprising:

an enclosure defining an opening in an end thereof;

a male member received in the enclosure and aligned with the opening, the male member comprising a plurality of pins each having a free end configured for electrically connecting with an electrical equipment, and a fixed end electrically connected with a wire configured for electrically connecting with another electrical equipment;

a female member mounted in the enclosure, the female member comprising a housing defining a plurality of through holes for receiving the pins respectively; and an operating member connected with one of the male member and the female member for driving the one of the male member and the female member to move forward or backward relative to the other one of the male member and the female member such that the free ends of the pins are received within the through holes respectively to allow the electrical connector to act as a female type connector, or extend out of the through holes of the housing to allow the electrical connector to act as a male type connector.

17. The electrical connector as claimed in claim 16, further comprising a hollow fixing member fixed with the male member for receiving the pins of the male member and the housing of the female member therein, the fixing member fittingly received in the opening of the enclosure.

18. The electrical connector as claimed in claim 17, wherein the male member and the fixing member are fixed with the enclosure, and the female member is moveable relative to the enclosure to cause the housing extending out of the fixing member and the free ends of the pins being received within the through holes of the housing to allow the electrical connector to act as the female type connector or cause the housing retracting into the fixing member to expose the free ends of the pins to allow the electrical connector to act as the male type connector.

19. The electrical connector as claimed in claim 17, wherein the female member is fixed with the enclosure, and the male member is moveable relative to the enclosure to cause the housing extending out of the fixing member and the free ends of the pins being received within the through holes of the housing to allow the electrical connector to act as the female type connector, or cause the housing being received into the fixing member to expose the free ends of the pins to allow the electrical connector to act as the male type connector.

20. The electrical connector as claimed in claim 17, wherein the operating member comprises a round knob exposed out of the enclosure and a threaded post extending from the knob in an axis of the knob, the one of the male member and the female member defining threads matched with the threaded post such that when the knob is rotated, the operating member rotates to drive the one of the male member and the female member to move linearly.

* * * * *